US008864522B2

(12) United States Patent
Lan et al.

(10) Patent No.: US 8,864,522 B2
(45) Date of Patent: Oct. 21, 2014

(54) UNIVERSAL SERIAL BUS CONNECTOR

(71) Applicant: Cheng Uei Precision Industry Co., Ltd., New Taipei (TW)

(72) Inventors: Rong-Qin Lan, Dong-Guan (CN); Yin-Lung Wu, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 21 days.

(21) Appl. No.: 13/789,662

(22) Filed: Mar. 7, 2013

(65) Prior Publication Data

US 2014/0256181 A1 Sep. 11, 2014

(51) Int. Cl.
*H01R 13/648* (2006.01)
*H01R 24/60* (2011.01)
*H01R 13/6581* (2011.01)

(52) U.S. Cl.
CPC ..... *H01R 24/60* (2013.01); *H01R 13/6581* (2013.01)
USPC ..... 439/607.23

(58) Field of Classification Search
CPC ..... H01R 23/6873; H01R 23/025
USPC ..... 439/607.23–607.26, 540.1, 541.5, 701, 439/676
See application file for complete search history.

(56) References Cited

U.S. PATENT DOCUMENTS

| | | | | |
|---|---|---|---|---|
| 7,556,528 | B1 * | 7/2009 | Ju | 439/541.5 |
| 7,588,445 | B2 * | 9/2009 | He et al. | 439/79 |
| 2003/0032313 | A1 * | 2/2003 | Kojima et al. | 439/79 |
| 2005/0009409 | A1 * | 1/2005 | Chen | 439/676 |
| 2009/0042448 | A1 * | 2/2009 | He et al. | 439/650 |
| 2009/0298338 | A1 * | 12/2009 | Zhang et al. | 439/607.28 |

* cited by examiner

*Primary Examiner* — Phuongchi T Nguyen
(74) *Attorney, Agent, or Firm* — Cheng-Ju Chiang

(57) ABSTRACT

A universal serial bus connector includes an insulating housing, a plurality of first terminals, second terminals and third terminals disposed to the insulating housing, an insulating cover disposed to a rear end of the insulating housing, a shielding shell surrounding the insulating housing and the insulating cover. Each of the first terminals has a first soldering portion. Each of the second terminals has a second soldering portion. Each of the third terminals has a third soldering portion. The insulating cover defines one row of first insertion slots and one row of second insertion slots. Rear ends of the first soldering portions and the second soldering portions, and the third soldering portions are respectively inserted into the first insertion slots and the second insertion slots. The rear ends of the first soldering portions, the second soldering portions and the third soldering portions are abreast arranged in two rows.

9 Claims, 5 Drawing Sheets

UNIVERSAL SERIAL BUS CONNECTOR

BACKGROUND OF THE INVENTION

1. Field of the Invention

The present invention generally relates to a connector, and more particularly to a universal serial bus connector.

2. The Related Art

In general, a conventional universal serial bus connector includes an insulating housing, a plurality of terminals, and a shielding shell surrounding the insulating housing. The insulating housing has a base body and a protruding portion protruding rearward from a middle of a rear surface of the base body. The base body of the insulating housing defines an inserting groove penetrating through a middle of a front surface thereof. The insulating housing defines a plurality of terminal grooves of which a part pass through a top surface of a top sidewall and a top of a rear sidewall of the inserting groove, and the other part pass through a bottom surface of the top sidewall and the top of the rear sidewall of the inserting groove or a top surface of a bottom sidewall and a bottom of the rear sidewall of the inserting groove. Each of the terminals has a fastening portion, a contact portion connecting with one end of the fastening portion, and a soldering portion connecting with the other end of the fastening portion. The terminals are disposed to the terminal grooves of the insulating housing with the contact portions thereof being exposed to the inserting groove or being exposed beyond the top surface of the top sidewall of the inserting groove of the insulating housing and the soldering portions thereof being exposed beyond a top surface of the protruding portion of the insulating housing or under a bottom surface of the protruding portion of the insulating housing to be soldered with a plurality of core wires of a cable.

However, because the soldering portions of the terminals are exposed beyond the top surface of the protruding portion of the insulating housing or under the bottom surface of the protruding portion of the insulating housing, the core wires of the cable need be soldered with the soldering portions of the terminals in different directions that complicates the soldering procedures of the core wires of the cable and the soldering portions of the terminals. As a result, a soldering efficiency of the universal serial bus connector is lowered.

SUMMARY OF THE INVENTION

An object of the present invention is to provide a universal serial bus connector. The universal serial bus connector includes an insulating housing, a plurality of first terminals, a plurality of second terminals, a plurality of third terminals, an insulating cover, a shielding shell surrounding the insulating housing and the insulating cover. The insulating housing includes a first base body, and a second base body protruding upward from one side of a top surface of the first base body. The first base body defines a first inserting groove penetrating through a front surface thereof, and the second base body defines a second inserting groove penetrating through a top surface and a front surface thereof. The first terminals are disposed to the first base body of the insulating housing. Each of the first terminals has a first fastening portion, a first contact portion extending forward from a front of the first fastening portion to be exposed in the first inserting groove, a first bending portion bent upward from a rear of the first fastening portion, and a first soldering portion extending rearward from a top of the first bending portion with a rear end thereof projecting behind the insulating housing. The second terminals are disposed to the first base body of the insulating housing. Each of the second terminals has a second fastening portion, a second contact portion extending forward from a front of the second fastening portion to be exposed in the first inserting groove, a second bending portion bent downward from a rear of the second fastening portion, and a second soldering portion extending rearward from a bottom of the second bending portion with a rear end thereof projecting behind the insulating housing. The third terminals are disposed to the second base body of the insulating housing. Each of the third terminals has a third fastening portion, a third contact portion extending forward from a front of the third fastening portion and then arched upward to stretch in the second inserting groove, and a third soldering portion extending rearward from a rear of the third fastening portion with a rear end thereof projecting behind the insulating housing and being levelly in alignment with one another. The third terminals are disposed to the second base body of the insulating housing. Each of the third terminals has a third fastening portion, a third contact portion extending forward from a front of the third fastening portion and then arched upward to stretch in the second inserting groove, and a third soldering portion extending rearward from a rear of the third fastening portion with a rear end thereof projecting behind the insulating housing. The insulating cover disposed to a rear end of the insulating housing has a main board blocking behind the insulating housing, a first supporting portion protruding rearward from a bottom of a rear surface of the main board, and a second supporting portion protruding rearward from a top of the rear surface of the main board. The insulating cover defines one row of first insertion slots penetrating through the main board and further opened in a top surface of the first supporting portion, and one row of second insertion slots penetrating through the main board and further opened in a top surface of the second supporting portion. The rear ends of the first soldering portions and the second soldering portions are respectively inserted in the first insertion slots and propped against bottom inner sidewalls of the first insertion slots, the rear ends of the third soldering portions are inserted in the second insertion slots and propped against bottom inner sidewalls of the second insertion slots. The rear ends of the first soldering portions of the first terminals and the rear ends of the second soldering portions of the second terminals are levelly in alignment with one another and the rear ends of the third soldering portions are levelly in alignment with one another. The rear ends of the first soldering portions, the rear ends of the second soldering portions and the rear ends of the third soldering portions are abreast arranged in two rows.

As described above, the rear ends of the first soldering portions and the second soldering portions are respectively inserted into the first insertion slots and propped against the bottom inner sidewalls of the first insertion slots to be located on the insulating cover, the rear ends of the first soldering portions and the second soldering portions are levelly in alignment with one another, and the rear ends of the third soldering portions are inserted into the second insertion slots and propped against the bottom inner sidewalls of the second insertion slots to be located on the insulating cover, the rear ends of the third soldering portions are levelly in alignment with one another, so the rear ends of the first soldering portions, the second soldering portions and the third soldering portions are abreast arranged in two rows, core wires of a cable can be soldered with the rear ends of the first soldering portions, the second soldering portions and the third soldering portions in the same direction. So that the soldering procedures of the core wires of the cable and the first soldering portions, the second soldering portions and the third soldering portions are simplified. As a result, a soldering efficiency of the universal serial bus connector is improved.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
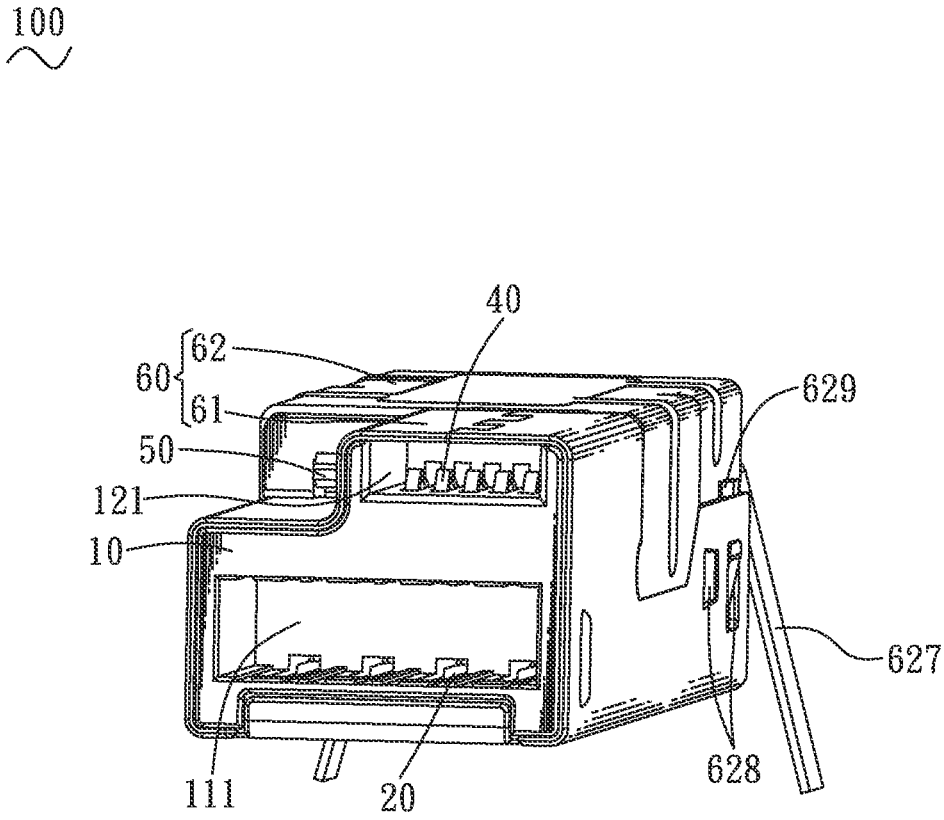
FIG. 1 is a perspective view of a universal serial bus connector in accordance with the present invention.
Figure 2:
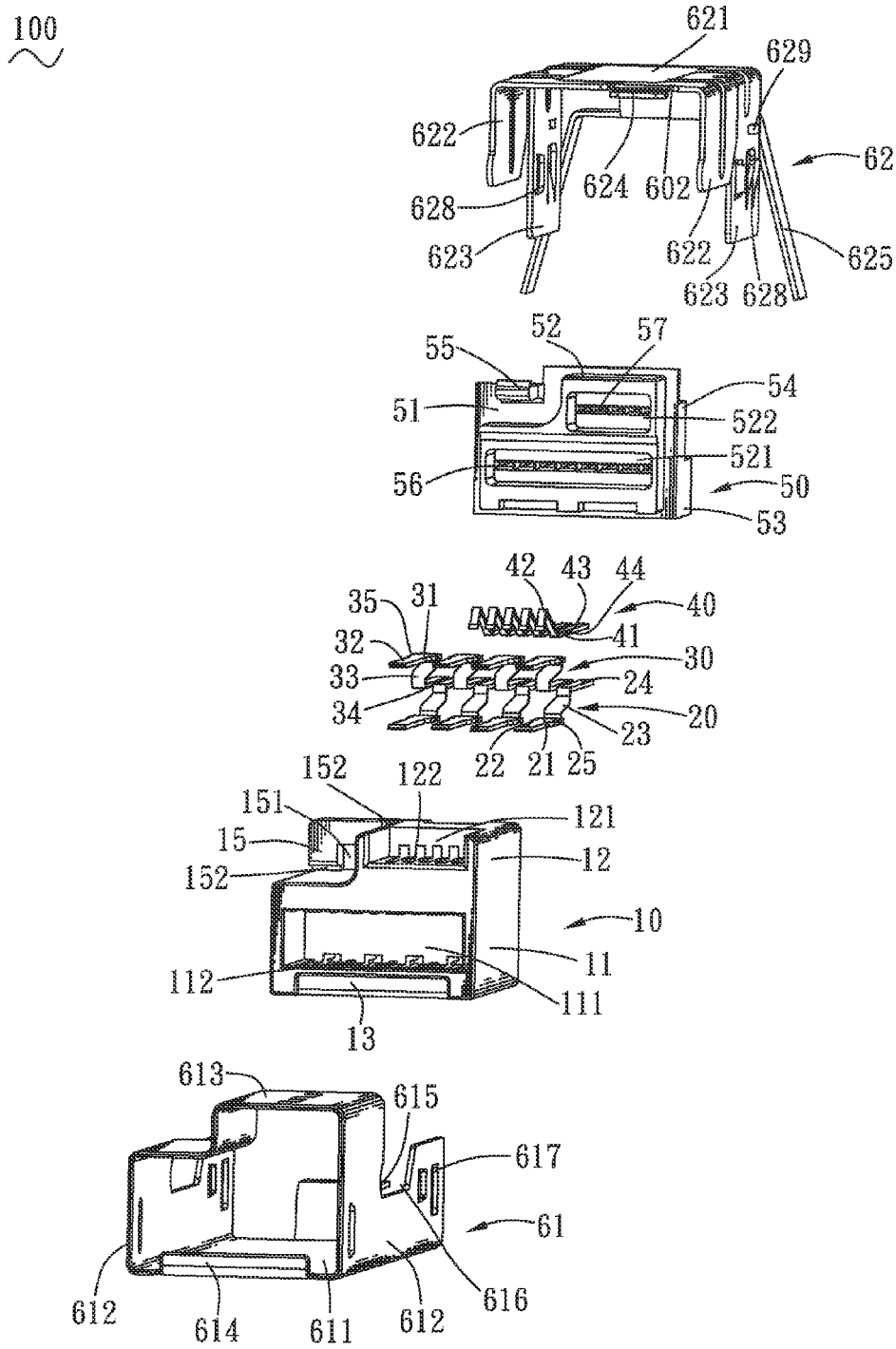
FIG. 2 is an exploded view of the universal serial bus connector of FIG. 1.
Figure 3:
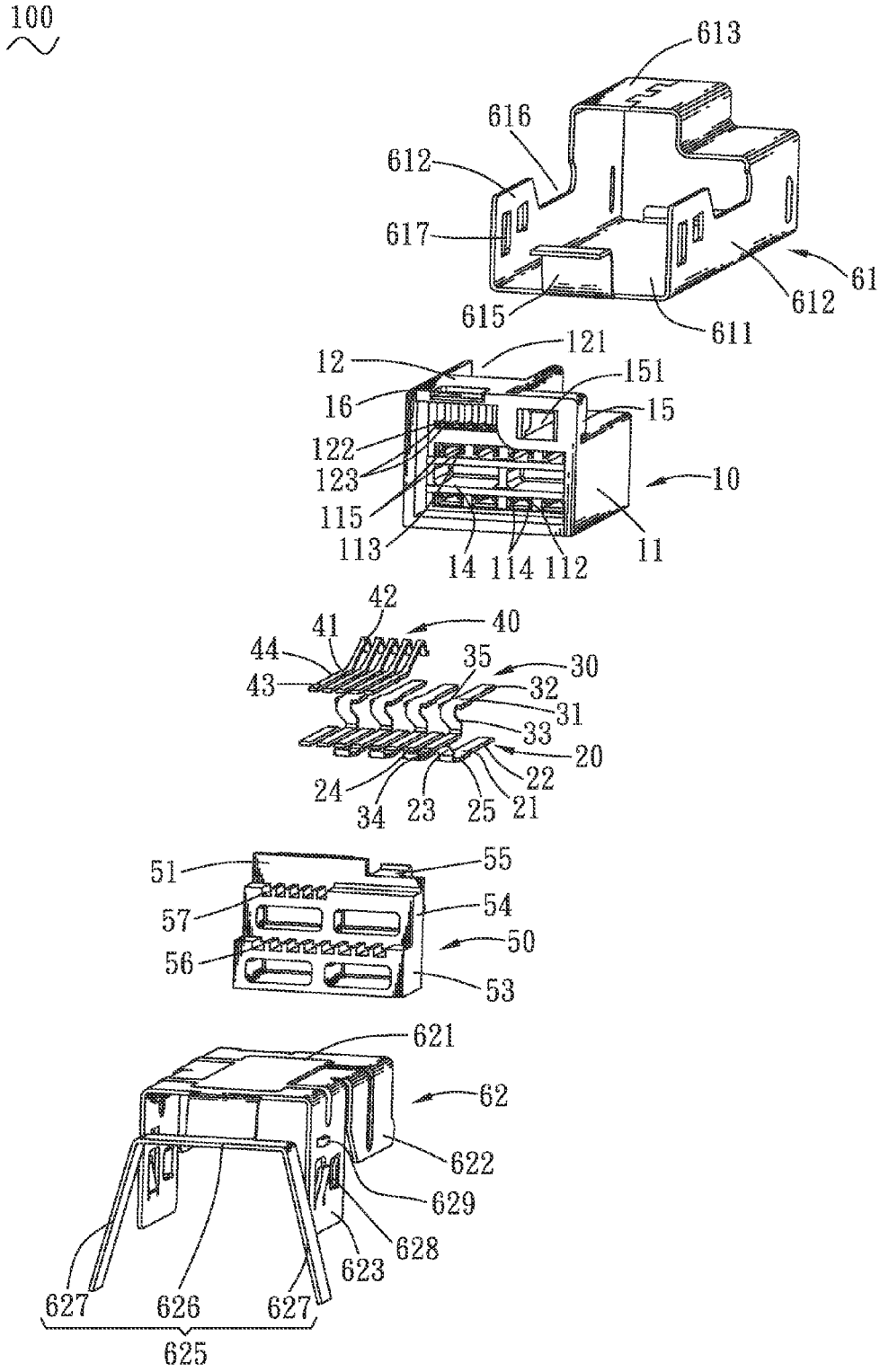
FIG. 3 is another exploded view of the universal serial bus connector of FIG. 1.

With reference to FIG. 1, FIG. 2 and FIG. 3, a universal serial bus connector 100 in accordance with the present invention is shown. The universal serial bus connector 100 includes an insulating housing 10, a plurality of first terminals 20, a plurality of second terminals 30, a plurality of third terminals 40, an insulating cover 50, and a shielding shell 60.

Figure 5:
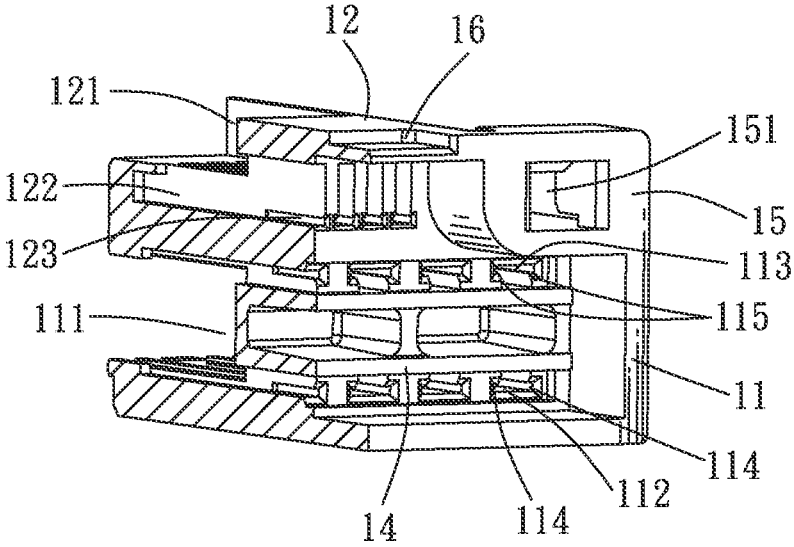
FIG. 5 is a sectional view of an insulating housing of the universal serial bus connector of FIG. 1.

Referring to FIG. 2, FIG. 3 and FIG. 5, the insulating housing 10 includes a rectangular first base body 11, and a rectangular second base body 12 protruding upward from one side of a top surface of the first base body 11. The first base body 11 defines a first inserting groove 111 penetrating through a middle of a front surface thereof. The second base body 12 defines a second inserting groove 121 penetrating through a front of a top surface and a top of a front surface thereof. The insulating housing 10 defines a plurality of first terminal grooves 112 penetrating through a top surface of a bottom sidewall and a rear sidewall of the first inserting groove 111, and a plurality of second terminal grooves 113 penetrating through a bottom surface of a top sidewall and the rear sidewall of the first inserting groove 111. The insulating housing 10 defines a plurality of third terminal grooves 122 penetrating through a top surface of a bottom sidewall and a rear sidewall of the second inserting groove 121. Two rear ends of two inner surfaces of two opposite sidewalls of the first terminal groove 112 are concaved oppositely to form two first fastening slots 114. Two rear ends of two inner surfaces of two opposite sidewalls of the second terminal groove 113 are concaved oppositely to form two second fastening slots 115. Two rear ends of two inner surfaces of two opposite sidewalls of the third terminal groove 122 are concaved oppositely to form two third fastening slots 123.

The first base body 11 defines a limiting groove 13 passing through a bottom edge of the front surface thereof. The limiting groove 13 is located under and spaced from the first inserting groove 111. The second base body 12 defines a fixing groove 16 passing through a rear edge of the top surface thereof. The fixing groove 16 is located in rear of and spaced from the second inserting groove 121. The insulating housing 10 defines an accommodating space 14 penetrating through a middle of a rear surface thereof and communicating with the first terminal grooves 112, the second terminal grooves 113 and the third terminal grooves 122. A rear of the other side of the top surface of the first base body 11 protrudes upward to form a fastening portion 15 connecting with the second base body 12. The fastening portion 15 defines a fastening groove 151 penetrating through a front surface, a rear surface and a bottom surface thereof. The fastening portion 15 defines two embedding slots 152 respectively passing through a bottom of a front surface of one sidewall of the fastening groove 151 away from the second base body 12 and passing through a bottom and one side edge of a front surface of the other sidewall of the fastening groove 151 connecting with the second base body 12.

Referring to FIG. 2 and FIG. 3, each of the first terminals 20 has an elongated first fastening portion 21 disposed horizontally, a first contact portion 22 extending forward from a front of the first fastening portion 21, a first bending portion 23 bent upward from a rear of the first fastening portion 21, and a first soldering portion 24 extending rearward from a top of the first bending portion 23. Two rear ends of two opposite sides of the first fastening portion 21 protrude oppositely to form two first teeth portions 25.

Referring to FIG. 2 and FIG. 3, each of the second terminals 30 has an elongated second fastening portion 31 disposed horizontally, a second contact portion 32 extending forward from a front of the second fastening portion 31, a second bending portion 33 bent downward from a rear of the second fastening portion 31, and a second soldering portion 34 extending rearward from a bottom of the second bending portion 33. Two rear ends of two opposite sides of the second fastening portion 31 protrude oppositely to form two second teeth portions 35.

Referring to FIG. 2 and FIG. 3, each of the third terminals 40 has an elongated third fastening portion 41 disposed horizontally, a third contact portion 42 extending forward and then arched upward from a front of the third fastening portion 41, and a third soldering portion 43 extending rearward from a rear of the third fastening portion 41. Two rear ends of two opposite sides of the third fastening portion 41 protrude oppositely to from two third teeth portions 44.

Figure 4:
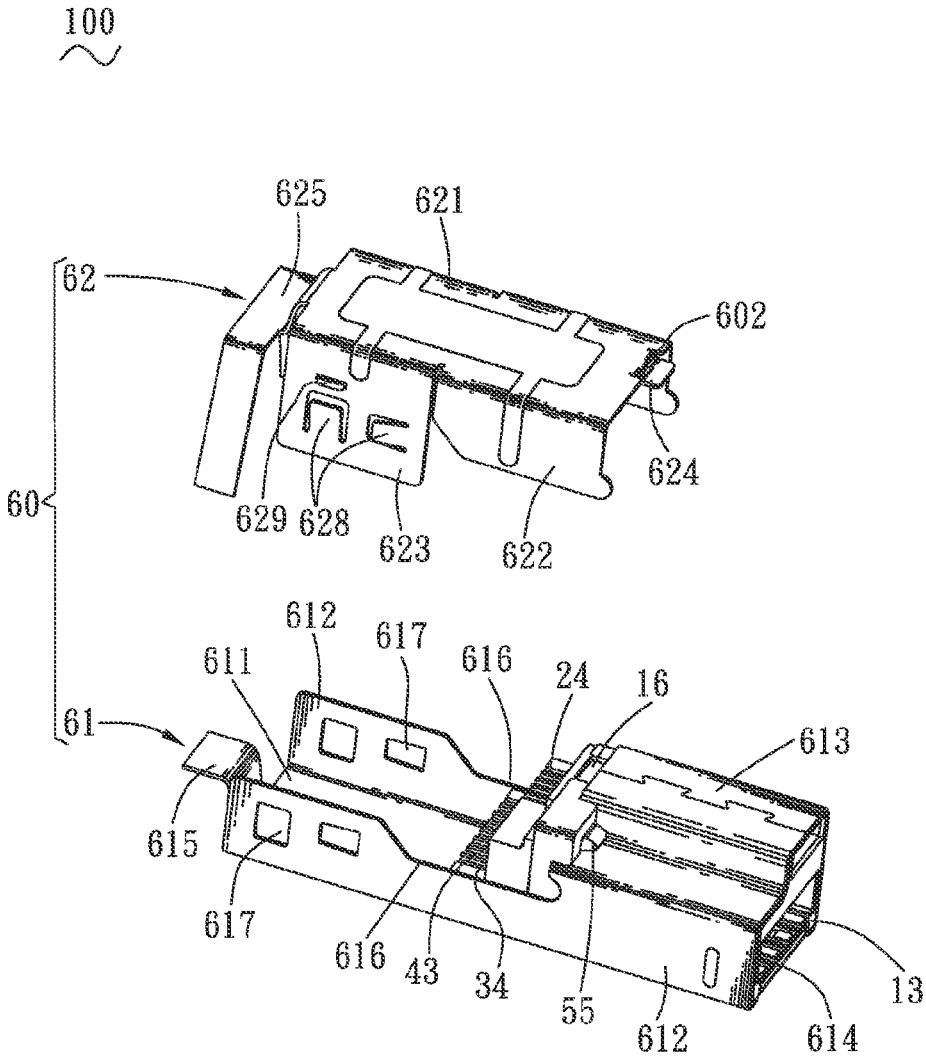
FIG. 4 is a partially exploded view of the universal serial bus connector of FIG. 1.

Referring to FIG. 2, FIG. 3 and FIG. 4, the insulating cover 50 has a main board 51, a locating block 52 protruding forward from a front surface of the main board 51, a first supporting portion 53 protruding rearward from a bottom of a rear surface of the main board 51, and a second supporting portion 54 protruding rearward from a top of the rear surface of the main board 51 and connecting with a front of a top surface of the first supporting portion 53. One side of a top of the front surface of the main board 51 protrudes forward and then bent upward to form a hooking portion 55 spaced from the locating block 52. The locating block 52 defines a first opening 521 penetrating through a bottom of a front surface thereof, and a second opening 522 penetrating through a top of the front surface thereof and located above the first opening 521. The insulating cover 50 defines one row of first insertion slots 56 penetrating through the main board 51 and further opened in a top surface of the first supporting portion 53, and one row of second insertion slots 57 penetrating through the main board 51 and further opened in a top surface of the second supporting portion 54. The first insertion slots 56 are communicated with the first opening 521 and the second insertion slots 57 are communicated with the second opening 522. The first insertion slots 56 and the second insertion slots 57 are abreast arranged in two rows. Bottom sidewalls of the first insertion slots 56 and the second insertion slots 57 are plane.

Referring to FIG. 2, FIG. 3 and FIG. 4, the shielding shell 60 includes a first shielding shell 61 and a second shielding shell 62 matched with the first shielding shell 61. The first shielding shell 61 has a bottom plate 611, two lateral plates 612 extending upward from two opposite sides of the bottom plate 611, and a top plate 613 extending upward and then bent towards each other from two fronts of two top edges of the two lateral plates 612. A middle of a front edge of the bottom plate 611 is bent upward to form a limiting piece 614. A middle of a rear edge of the bottom plate 611 is bent upward and then bent rearward to form a first clamping portion 615. Two middles of the two top edges of the two lateral plates 612 are concaved downward to form two notches 616. A rear end of each lateral plate 612 defines two restricting holes 617.

Referring to FIG. 2, FIG. 3 and FIG. 4, the second shielding shell 62 has a base plate 621, two first buckling plates 622 extending downward from two fronts of two bottom edges of the base plate 621, two second buckling plates 623 extending downward from two rears of the two bottom edges of the base plate 621. A front edge of the base plate 621 is recessed inward to form a lacking groove 602. One inner sidewall of the lacking groove 602 extends forward, then bent downward and further extends forward to form an elastic piece 624. The two second buckling plates 623 are respectively punched outward to form two restricting pieces 628 and a blocking portion 629 located above the two restricting pieces 628. A middle of a rear edge of the base plate 621 is connected with a second clamping portion 625 which has a connecting portion 626 slantwise extending downward and rearward, then extending rearward and further expanding outward from a middle of a rear edge of the base plate 621, and two clamping arms 627 slantwise extending downward and outward from two opposite sides of the connecting portion 626.

Referring to FIG. 1, FIG. 2, FIG. 3, FIG. 4 and FIG. 5, when the universal serial bus connector 100 is assembled, at first, the first terminals 20 and the second terminals 30 are disposed to the first base body 11 of the insulating housing 10, and the third terminals 40 are disposed to the second base body 12 of the insulating housing 10. Specifically, the first fastening portion 21 of each first terminal 20 is disposed to the first terminal groove 112 with the two first teeth portions 25 interfering with two inner surfaces of two opposite sidewalls of the two first fastening slots 114. The first contact portion 22 of each first terminal 20 is exposed beyond the top surface of the bottom sidewall of the first inserting groove 111 to be exposed in the first inserting groove 111. The first bending portion 23 of each first terminal 20 and a front end of the first soldering portion 24 of each first terminal 20 are located in the accommodating space 14. A rear end of the first soldering portion 24 of each first terminal 20 projects behind the insulating housing 10. The second fastening portion 31 of each second terminal 30 is disposed to the second terminal groove 113 with the two second teeth portions 35 interfering with two inner surfaces of two opposite sidewalls of the two second fastening slots 115. The second contact portion 32 of each second terminal 30 is exposed under the bottom surface of the top sidewall of the first inserting groove 111 to be exposed in the first inserting groove 111. The second bending portion 33 of each second terminal 30 and a front end of the second soldering portion 34 of each second terminal 30 are located in the accommodating space 14. A rear end of the second soldering portion 34 of each second terminal 30 projects behind the insulating housing 10. The rear ends of the first soldering portions 24 of the first terminals 20 and the rear ends of the second soldering portions 34 of the second terminals 30 are levelly in alignment with one another. The third fastening portion 41 of each third terminal 40 is disposed to the third terminal groove 122 with the two third teeth portions 44 interfering with two inner surfaces of two opposite sidewalls of the two third fastening slots 123. The third contact portion 42 of each third terminal 40 is partially exposed beyond the top surface of the bottom sidewall of the second inserting groove 121 to be exposed in the second inserting groove 121. A front end of the third soldering portion 43 of each third terminal 40 is located in the accommodating space 14. A rear end of the third soldering portion 43 of each third terminal 40 projects behind the insulating housing 10. The rear ends of the third soldering portions 43 are levelly in alignment with one another. So the rear ends of the first soldering portions 24, the rear ends of the second soldering portions 34 and the rear ends of the third soldering portions 43 are abreast arranged in two rows.

Next, the insulating cover 50 is disposed to a rear end of the insulating housing 10 with a front end thereof projecting into the accommodating space 14. Specifically, the locating block 52 is received in the accommodating space 14. The hooking portion 55 passes through the fastening groove 151 and hooks a front surface of a top sidewall of the fastening groove 151. The main board 51 is blocked behind the rear surface of the insulating housing 10. The first supporting portion 53 and the second supporting portion 54 are exposed behind the insulating housing 10.

The rear ends of the first soldering portions 24 of the first terminals 20 and the second soldering portions 34 of the second terminals 30 are respectively inserted in the first insertion slots 56 through the first opening 521 and propped against the bottom inner sidewalls of the first insertion slots 56 to be located on the insulating cover 50. The rear ends of the third soldering portions 43 are inserted in the second insertion slots 57 through the second opening 522 and propped against the bottom inner sidewalls of the second insertion slots 57 to be located on the insulating cover 50.

Again, the shielding shell 60 surrounding the insulating housing 10 and the insulating cover 50. The first shielding shell 61 surrounds the insulating housing 10, specifically, the insulating housing 10 together with the first terminals 20, the second terminals 30, the fourth terminals 40 and the insulating cover 50 is inserted in the first shielding shell 61. One side of a rear edge of the top plate 613 is embedded in the embedding slots 152 of the insulating housing 10. The limiting piece 614 is limited in the limiting groove 13. So, the first shielding shell 61 is fastened to the insulating housing 10.

The universal serial bus connector 100 is soldered with a cable (not shown) which includes a plurality of core wires (not shown). The core wires of the cable are soldered with the rear ends of the first soldering portions 24 of the terminals 20, the second soldering portions 34 of the second terminals 30 and the third soldering portions 43 of the third terminals 40 which are located on the insulating cover 50. So that the soldering procedures of the core wires of the cable and the first soldering portions 24, the second soldering portions 34 and the third soldering portions 43 are simplified.

At last, the second shielding shell 62 is disposed to a rear end of the insulating housing 10, the insulating cover 50 and the first shielding shell 61. Specifically, the elastic piece 624 of the second shielding shell 62 is fixed in the fixing groove 16 of the insulating housing 10. The two first buckling plates 622 of the second shielding shell 62 are buckled in the two notches 616 of the first shielding shell 61. The two second buckling plates 623 of the second shielding shell 62 are attached to the two rear ends of the two lateral plates 612 of the first shielding shell 61 with the two restricting pieces 628 restricted in the two restricting holes 617 of the first shielding shell 61. Two bottoms of the two blocking portions 629 resist against two top edges of the two rear ends of the two lateral plates 612. So that the second shielding shell 62 is fastened to the insulating housing 10 and the first shielding shell 61. The second clamping portion 625 of the second shielding shell 62 is disposed above the first clamping portion 615 of the first shielding shell 61. The cable is located between the first shielding shell 61 and the second shielding shell 62 with a rear end thereof projecting behind the first shielding shell 61 and the second shielding shell 62. The two clamping arms 627 are bent towards each other to clamp the cable between the first clamping portion 615 and the second clamping portion 625.

As described above, the rear ends of the first soldering portions 24 and the second soldering portions 34 are respectively inserted into the first insertion slots 56 and propped against the bottom inner sidewalls of the first insertion slots 56 to be located on the insulating cover 50, the rear ends of the first soldering portions 24 and the second soldering portions 34 are levelly in alignment with one another, and the rear ends of the third soldering portions 43 are inserted into the second insertion slots 57 and propped against the bottom inner sidewalls of the second insertion slots 57 to be located on the insulating cover 50, the rear ends of the third soldering portions 43 are levelly in alignment with one another, so the rear ends of the first soldering portions 24, the second soldering portions 34 and the third soldering portions 43 are abreast arranged in two rows, the core wires of the cable can be soldered with the rear ends of the first soldering portions 24, the second soldering portions 34 and the third soldering portions 43 in the same direction. So that the soldering procedures of the core wires of the cable and the first soldering portions 24, the second soldering portions 34 and the third soldering portions 43 are simplified. As a result, a soldering efficiency of the universal serial bus connector 100 is improved.

What is claimed is:

1. A universal serial bus connector, comprising:

an insulating housing including a first base body, and a second base body protruding upward from one side of a top surface of the first base body, the first base body defining a first inserting groove penetrating through a front surface thereof, and the second base body defining a second inserting groove penetrating through a top surface and a front surface thereof;

a plurality of first terminals disposed to the first base body of the insulating housing, each of the first terminals having a first fastening portion, a first contact portion extending forward from a front of the first fastening portion to be exposed in the first inserting groove, a first bending portion bent upward from a rear of the first fastening portion, and a first soldering portion extending rearward from a top of the first bending portion with a rear end thereof projecting behind the insulating housing;

a plurality of second terminals disposed to the first base body of the insulating housing, each of the second terminals having a second fastening portion, a second contact portion extending forward from a front of the second fastening portion to be exposed in the first inserting groove, a second bending portion bent downward from a rear of the second fastening portion, and a second soldering portion extending rearward from a bottom of the second bending portion with a rear end thereof projecting behind the insulating housing;

a plurality of third terminals disposed to the second base body of the insulating housing, each of the third terminals having a third fastening portion, a third contact portion extending forward from a front of the third fastening portion and then arched upward to stretch in the second inserting groove, and a third soldering portion extending rearward from a rear of the third fastening portion with a rear end thereof projecting behind the insulating housing;

an insulating cover disposed to a rear end of the insulating housing, having a main board blocking behind the insulating housing, a first supporting portion protruding rearward from a bottom of a rear surface of the main board, and a second supporting portion protruding rearward from a top of the rear surface of the main board, the insulating cover defining one row of first insertion slots penetrating through the main board and further opened in a top surface of the first supporting portion, and one row of second insertion slots penetrating through the main board and further opened in a top surface of the second supporting portion, the rear ends of the first soldering portions and the second soldering portions being respectively inserted in the first insertion slots and propped against bottom inner sidewalls of the first insertion slots, the rear ends of the third soldering portions being inserted in the second insertion slots and propped against bottom inner sidewalls of the second insertion slots, the rear ends of the first soldering portions of the first terminals and the rear ends of the second soldering portions of the second terminals being levelly in alignment with one another and the rear ends of the third soldering portions being levelly in alignment with one another, the rear ends of the first soldering portions, the rear ends of the second soldering portions and the rear ends of the third soldering portions being abreast arranged in two rows; and a shielding shell surrounding the insulating housing and the insulating cover;

wherein the insulating housing defines an accommodating space penetrating through a rear surface thereof, the insulating cover has a locating block protruding forward from a front surface of the main board, the locating block is received in the accommodating space.

2. The universal serial bus connector as claimed in claim 1, wherein the locating block defines a first opening penetrating through a bottom of a front surface thereof, and a second opening penetrating through a top of the front surface thereof and located above the first opening, the first insertion slots communicate with the first opening and the second insertion slots communicate with the second opening, the rear ends of the first soldering portions and the second soldering portions are respectively inserted into the first insertion slots through the first opening, the rear ends of the third soldering portions are inserted into the second insertion slots through the second opening.

3. The universal serial bus connector as claimed in claim 1, wherein the insulating housing defines a plurality of first terminal grooves penetrating through a top surface of a bottom sidewall and a rear sidewall of the first inserting groove, and a plurality of second terminal grooves penetrating through a bottom surface of a top sidewall and the rear sidewall of the first inserting groove, a plurality of third terminal grooves penetrating through a top surface of a bottom sidewall and a rear sidewall of the second inserting groove, the first fastening portion of each first terminal is disposed to the first terminal groove, the second fastening portion of each second terminal is disposed to the second terminal groove and the third fastening portion of each third terminal is disposed to the third terminal groove.

4. The universal serial bus connector as claimed in claim 3, wherein two rear ends of two inner surfaces of two opposite sidewalls of the first terminal groove are concaved oppositely to form two first fastening slots, two rear ends of two inner surfaces of two opposite sidewalls of the second terminal groove are concaved oppositely to form two second fastening slots, and two rear ends of two inner surfaces of two opposite sidewalls of the third terminal groove are concaved oppositely to form two third fastening slots, two rear ends of two opposite sides of the first fastening portion protrude oppositely to form two first teeth portions interfering with two inner surfaces of two opposite sidewalls of the two first fastening slots, two rear ends of two opposite sides of the second fastening portion protrude oppositely to form two second teeth portions interfering with two inner surfaces of two opposite sidewalls of the two second fastening slots, and two rear ends of two opposite sides of the third fastening portion protrude oppositely to form two third teeth portions interfering with two inner surfaces of two opposite sidewalls of the two third fastening slots.

5. The universal serial bus connector as claimed in claim 1, wherein a rear of the other side of the top surface of the first base body protrudes upward to form a fastening portion connecting with the second base body, the fastening portion defines a fastening groove penetrating through a front surface, a rear surface and a bottom surface thereof, one side of a top of the front surface of the main board protrudes forward and then bent upward to form a hooking portion, the hooking portion passes through the fastening groove and hooks a front surface of a top sidewall of the fastening groove.

6. The universal serial bus connector as claimed in claim 5, wherein the fastening portion defines two embedding slots respectively passing through a bottom of a front surface of one sidewall of the fastening groove away from the second base body and passing through a bottom and one side edge of a front surface of the other sidewall of the fastening groove connecting with the second base body, the shielding shell includes a first shielding shell surrounding the insulating housing, the first shielding shell has a top plate, one side of a rear edge of the top plate is inserted into the embedding slots.

7. The universal serial bus connector as claimed in claim 6, wherein the first base body defines a limiting groove passing through a bottom edge of the front surface thereof, the first shielding shell has a bottom plate of which a front edge is bent upward to form a limiting piece limited in the limiting groove.

8. The universal serial bus connector as claimed in claim 6, wherein the second base body defines a fixing groove passing through a rear edge of the top surface thereof, the shielding shell includes a second shielding shell matched with the first shielding shell, the second shielding shell disposed to a rear end of the insulating housing, the insulating cover and the first shielding shell has a base plate, a front edge of the base plate is recessed inward to form a lacking groove, one inner sidewall of the lacking groove extends forward, then bent downward and further extends forward to form an elastic piece fixed in the fixing groove.

9. The universal serial bus connector as claimed in claim 8, wherein the first shielding shell has a bottom plate, two lateral plates extending upward from two opposite sides of the bottom plate, two top edges of the two lateral plates are concaved downward to form two notches, a rear end of each lateral plate defines two restricting holes, the second shielding shell has two first buckling plates extending downward from two fronts of two bottom edges of the base plate, and two second buckling plates extending downward from two rears of the two bottom edges of the base plate, the two first buckling plates are buckled in the two notches, the two second buckling plates are attached to the two rear ends of the two lateral plates with the two restricting pieces restricted in the two restricting holes, two bottoms of the two blocking portions resist against two top edges of the two rear ends of the two lateral plates.

* * * * *